US007013593B2

(12) United States Patent
Pettersson et al.

(10) Patent No.: US 7,013,593 B2
(45) Date of Patent: Mar. 21, 2006

(54) HOLDER DEVICE

(75) Inventors: Rolf Pettersson, Torshälla (SE); Åke Jansson, Eskilstuna (SE)

(73) Assignee: SAAB AB, Linköping (SE)

( * ) Notice: Subject to any disclaimer, the term of this patent is extended or adjusted under 35 U.S.C. 154(b) by 58 days.

(21) Appl. No.: 10/792,786

(22) Filed: Mar. 5, 2004

(65) Prior Publication Data

US 2004/0244263 A1 Dec. 9, 2004

(30) Foreign Application Priority Data

Mar. 7, 2003 (SE) ..... 0300596

(51) Int. Cl.
*F41G 1/00* (2006.01)

(52) U.S. Cl. ..... 42/148; 42/124

(58) Field of Classification Search ..... 42/124, 42/148; 89/37.01, 37.04, 41.17; 248/590, 248/689, 693
See application file for complete search history.

(56) References Cited

U.S. PATENT DOCUMENTS

| | | | | |
|---|---|---|---|---|
| 1,641,019 A | | 8/1927 | Woods | |
| 2,367,762 A | * | 1/1945 | Eiane | 42/148 |
| 2,510,289 A | | 6/1950 | Livermore | |
| 2,710,453 A | | 6/1955 | Beverly | |
| 3,153,856 A | | 10/1964 | Felix | |
| 3,178,823 A | | 4/1965 | Lipski | |
| 3,882,609 A | * | 5/1975 | Troutman | 42/124 |
| 4,026,054 A | | 5/1977 | Snyder | |
| 4,027,414 A | * | 6/1977 | Felix | 42/127 |
| 4,461,087 A | | 7/1984 | Norman | |

FOREIGN PATENT DOCUMENTS

DE 3241753 A1 5/1984

* cited by examiner

*Primary Examiner*—Teri Pham Luu
*Assistant Examiner*—Bret Hayes
(74) *Attorney, Agent, or Firm*—Venable LLP; Eric J. Franklin

(57) ABSTRACT

The invention relates to a holder device configured for fastening to a substantially cylindrical body, such as a gun barrel, for the support of equipment such as a sight. The holder device comprises at least two holder elements, one holder element being configured for secure fixing to the cylindrical body and the other one being arranged such that it is movably coupled to the first-named holder element. According to the invention, the holder elements are arranged such that they are rotatable in relation to each other about a common axis between a first position, the transport position, and a second position, the activated position, and one of the holder elements is axially displaceable along the common axis from a position of equilibrium defined by a spring arrangement. The holder device reduces the transmission of axial recoil motions between the holder elements.

8 Claims, 3 Drawing Sheets

HOLDER DEVICE

The present invention relates to a holder device, configured for fastening to a substantially cylindrical body, such as a gun barrel, for the support of equipment such as a sight, which holder device comprises at least two holder elements, one of the holder elements being configured for secure fixing to the cylindrical body and another of the holder elements being arranged such that it is movably coupled to the first-named holder element, which holder elements are arranged so as to be mutually rotatable in relation to each other about a common rotation axis between a first position, the transport position, and a second position, the activated position.

An example of such a holder device is previously known from U.S. Pat. No. 3,178,823. In weapons applications, in particular, the holder devices are subjected to strong forces and, not least, in the longitudinal direction of the weapon. The holder arrangement according to the said US document has no especially effective arrangement for handling these forces in the longitudinal direction of the weapon.

The object of the present invention is to produce a holder device which is simple in its design, is easy to adjust and which tolerates strong forces, especially in the longitudinal direction of the weapon.

The object of the invention is achieved by a holder device, characterized in that one of the holder elements is provided with fastening points for securing the two ends of a mechanical shaft, in that the common rotation axis is located at the centre of rotation of the mechanical shaft and in that one of the holder elements is axially displaceable along the mechanical shaft from a position of equilibrium defined by a spring arrangement. The introduction of a design having axial displacement under spring action has produced a holder device which very gently supports equipment fitted in the holder device. In a weapons application, the axial recoil motion from the weapon is reduced. In principle, the motional force is transmitted from holder element to holder element only through friction in the coupling between the holder elements.

The supported equipment can be constituted by a sight for visible light, an IR-sight, a laser sight or similar equipment and often contains components which can be damaged by shocks.

In this context, it can be stated that an example of a spring arrangement with position of equilibrium is previously known per se from U.S. Pat. No. 3,153,856, which shows a sight holder without rotational motion between integral components.

According to one advantageous embodiment, the holder device is characterized in that the spring arrangement comprises a first compression spring acting between a first fastening point and the second holder element and a second compression spring acting between a second fastening point and the second holder element. The spring arrangement creates in a simple manner a balanced design, in which an accidental displacement in the axial direction during, for example, the firing phase for a weapon is easily counterbalanced, without subjecting the equipment supported by the holder device to powerful shocks.

According to another advantageous embodiment, the fastening points for securement of the common axis comprise adjustable eccentric members, such as eccentric bearing bushings. These eccentric members allow equipment supported by the holder device to be to some extent adjustable in relation to the body to which the holder device is fixed, without thereby limiting the axial mobility of the holder device. In a weapons context, this can be utilized for setting up the shot.

According to yet another advantageous embodiment, the holder device comprises a locking member arranged to lock the holder elements in at least the activated position. Advantageously, the locking member can in this case comprise two arms coupled between the common axis and one holder element and which, under spring action, are displaceable in the axial direction of the common axis and which arms comprise lugs for locking engagement with the second holder element. By rotating one holder element in relation to the second holder element from a first position into a second, active position, the lugs of the arms will grip around the second holder element and, in a stable and simple manner, detain the holder element in the active position. In order to return to the transport position, the arms are pressed together by the operator, whereby the lugs of the arms lose their grip around the second holder element and the holder elements can regain the transport position.

According to a further advantageous embodiment, the second holder element comprises two arms mounted about the common axis, which arms, at that end of the arms which is remote from the axis, support a coupling rail suitable for the connection of equipment. Advantageously, the first compression spring is in this case arranged to act between the first fastening point and one arm of the second holder element, whilst the second compression spring is arranged to act between the second fastening point and the second arm of the second holder element, and the arms of the locking member are arranged so as, under the influence of a third compression spring, to bear against one arm each of the second holder element. The two-armed configuration of the second holder element makes the holder device stable, at the same time as the integral spring functions can be simply produced using three compression springs.

In order to produce simple and secure mounting of the holder device on a body, the holder device according to one refinement of the invention is configured with recessed grooves in one holder element, which grooves are purpose-made for a band-shaped material intended to fasten the holder device to the cylindrical body.

The invention will be described in greater detail below by means of an illustrative embodiment and with reference to the appended drawings, in which.

Figure 1:
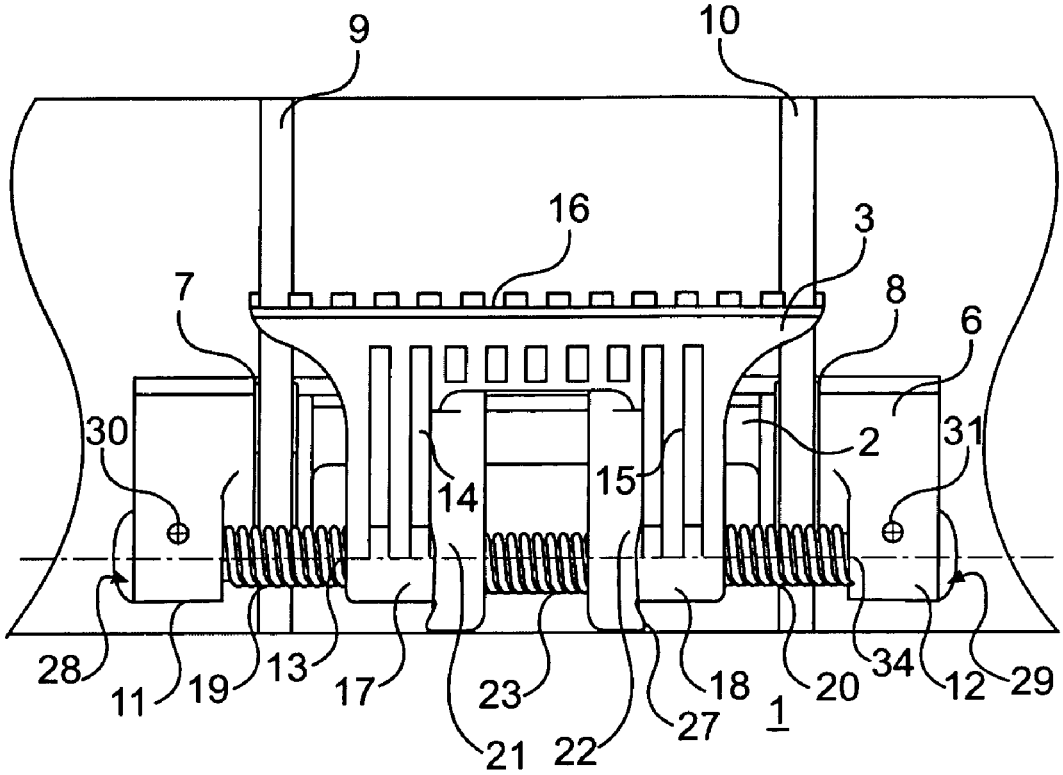
FIG. 1 shows in side view an example of a holder device according to the invention, mounted on a gun barrel of a weapon.
Figure 2:
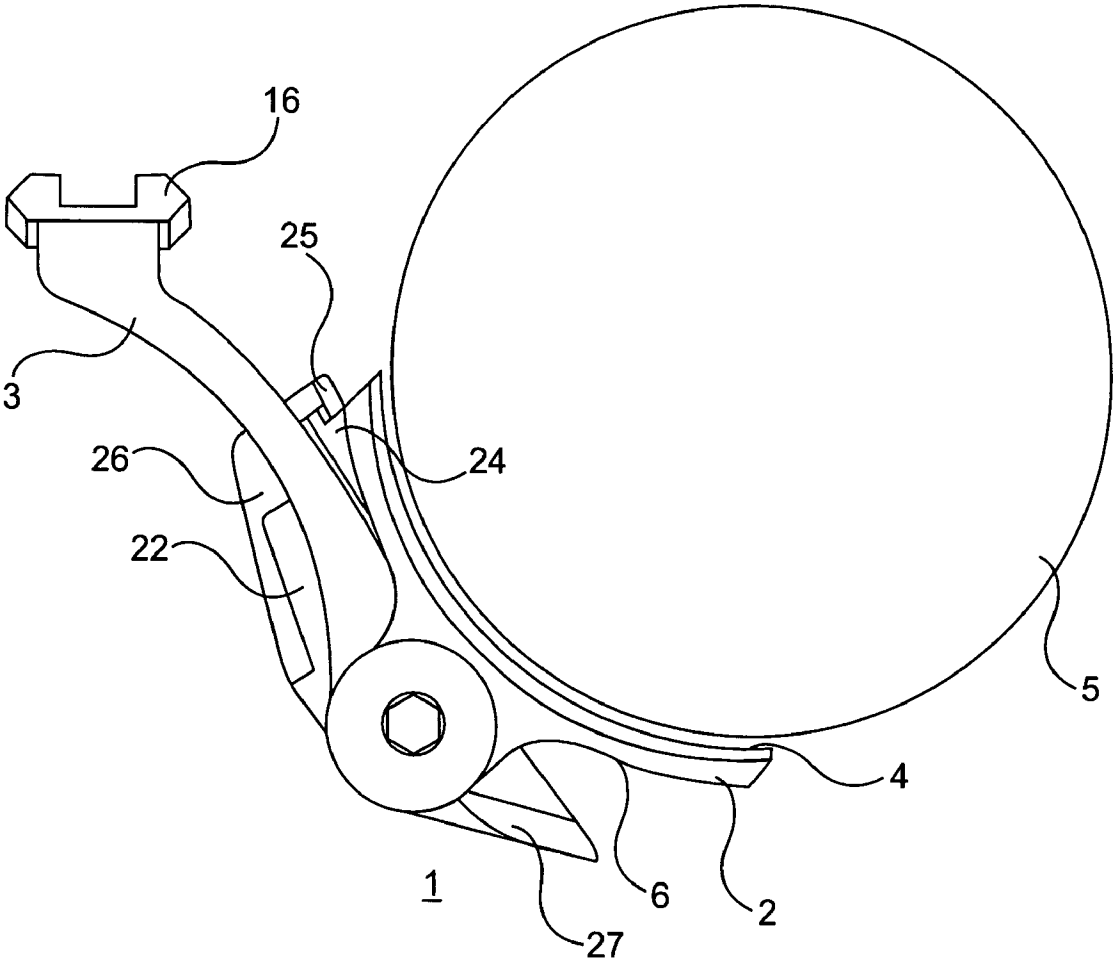
FIG. 2 shows in front view the holder device according to FIG. 1 in activated position, mounted on a gun barrel of a weapon.
Figure 3:
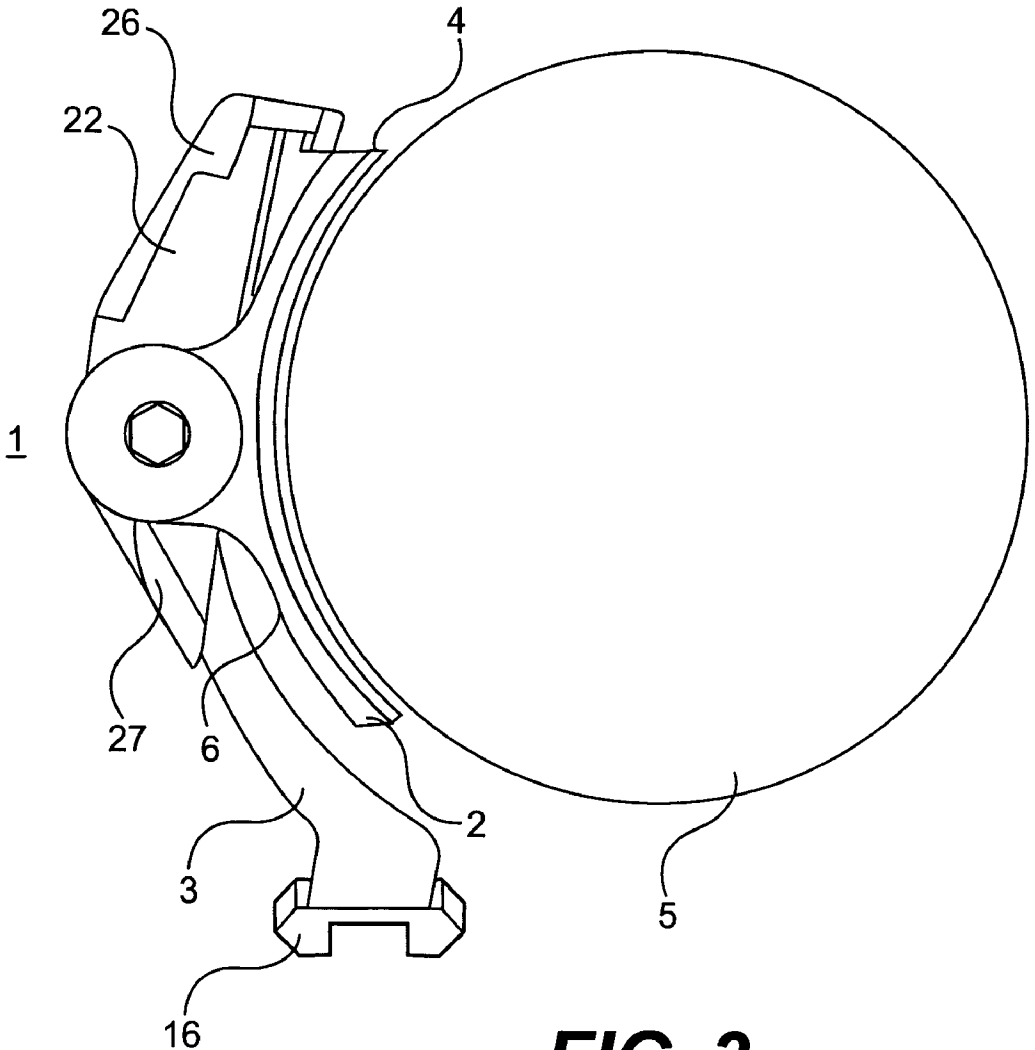
FIG. 3 shows in front view the holder device according to FIG. 1 in transport position, mounted on a gun barrel of a weapon.

According to the embodiment shown in FIGS. 1–3, the holder device 1 comprises a first holder element 2 and a second holder element 3.

The holder element 2 is provided with a surface 4 designed to fit the body 5, in this case a gun barrel, on which the holder element is to be mounted. A surface 6 opposite the surface 4 is provided with grooves 7, 8 for receiving straps 9, 10. These straps anchor the holder element on the gun barrel and the grooves prevent the straps from sliding out of position. Alternatively or as a complement to the straps, the holder element 2 can be glued to the body 5. Each end of the holder element comprises a fastening point 11, 12 for a mechanical shaft 13 having a rotation axis 34. The fastening point can incorporate an eccentric bearing of the type which is shown in FIG. 4 and the function of which will be described in greater detail later.

The second holder element 3 comprises two arms 14, 15 and a part, in the form of a rail 16, which connects the arms. The function of the rail 16 is to create a coupling to the equipment to be supported by the holder element and constituted, for example, by a sight means. The free ends 17, 18 of the arms 14, 15 of the second holder element are placed rotatably about the shaft 13. A first and a second compression spring 19, 20 are disposed on the shaft 13 between the fastening point 11 and the end 17 of the arm 14 and between the fastening point 12 and the end 18 of the arm 15 respectively. Apart from the fact that the second holder element can be rotated about the shaft 13, the holder element, if subjected to forces, such as, for example, the recoil forces generated when a weapon is fired, can also be displaced axially relative to the shaft 13. When the force effect ceases, the holder element 3 returns to the position of equilibrium defined by the compression springs.

Also contained in the illustrated holder device is a locking member for detaining the holder element 3 in the transport position and activated position respectively. The locking member comprises two arms 21, 22 and a compression spring 23. The two arms are connected between the shaft 13 and the first holder element 2 and are displaceable in the longitudinal direction of the shaft 13. The positions of the arms 21 and 22 are defined by the position of the arms 14, 15 of the holder element 3 and by the intermediate compression spring 23. A groove 24 in the arms interacts with a longitudinal lug 25 in the first holder element and holds the arms 21, 22 in place, at the same time as they are allowed to slide axially. Both arms 21 and 22 are further provided with a lug 26 at the same end of the arms in which the groove 24 is made. The function of the lugs 26 is, in the activated position of the holder device 1, to retain the second holder element in the activated position shown in FIG. 2. In order to detain the second holder element 3 in the transport position, each of the arms 21 and 22 can be provided with a lug 27 also at the other end of the arms. In FIG. 3, the second holder element 3 is shown in the transport position. In the illustrated embodiment, the lugs 26 and 27 are configured with a somewhat different function. The lugs 26 create a locking mechanism which requires the arms 21, 22 to be manually pressed together to leave the activated position. The locking in the transport position does not require any manual pressing-together of the arms. Instead, it is sufficient to rotate the second holder element to the activated position. The second holder element 3 will thereupon slide past the lugs 27, since the transition between lug and arm is of soft configuration.

Figure 4:
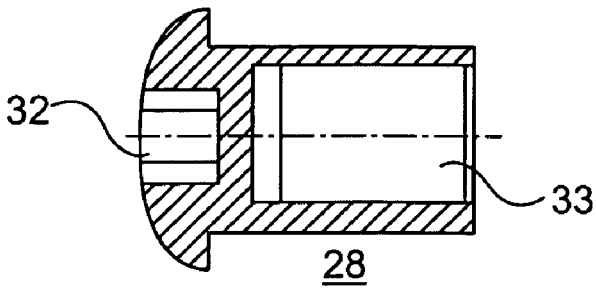
FIG. 4 shows in sectional view an example of an eccentric bushing which can form part of the holder device according to the invention.

The shaft 13 is mounted in eccentric bushings 28, 29 of the type shown in greater detail in FIG. 4. As can be seen from this figure, the space 33 for receiving the shaft 13 is eccentric by virtue of the differing thickness of the bushing. For adjusting the position of the bushing there is a recess 32, here designed to fit an Allen key. By rotating the bushings at the fastening points 11 and 12, the alignment of the second holder element 3 of the holder device can be adjusted so as, for example, to create better consistency between the direction of action and the sight direction of the gun barrel 5. In order to lock the shaft 13 relative to the bearing bushings 28, 29, locking screws 30, 31 are disposed connected to the fastening points 11 and 12.

The invention is not limited to the embodiments shown by way of examples but can be subject to modifications within the scope of the following patent claims.

What is claimed is:

1. A holder device configured for fastening to a substantially cylindrical body, for the support of equipment, the device comprising:

a mechanical shaft;

at least two holder elements, a first of the holder elements is operative to be securely fixed to the cylindrical body, a second of the holder elements is movably coupled to the first holder element, the first holder element and the second holder element comprising two arms and being mutually rotatable in relation to each other about a common rotation axis between a first transport position and a second activated position, wherein one of the holder elements includes fastening points for securing ends of the mechanical shaft, such that the common rotation axis is located at a center of rotation of the mechanical shaft;

a locking member operative to lock the at least two holder elements at least in the activated position; and a spring arrangement operative to define a position of equilibrium along the mechanical shaft, wherein one of the holder elements is axially displaceable along the mechanical shaft from the position of equilibrium, wherein the spring arrangement comprises a first compression spring acting between a first fastening point and a first arm of the second of the holder elements, a second compression spring acting between a second fastening point and a second arm of the second of the holder elements, and a third compression spring, wherein the arms of the second locking member are arranged such that, under the influence of the third compression spring, they each bear against one arm of the second holder element.

2. The holder device according to claim 1, wherein the cylindrical body is a gun barrel.

3. The holder device according to claim 1, wherein the equipment comprises a sight.

4. The holder device according to claim 1, further comprising:

adjustable eccentric members arranged at the fastening points.

5. The holder device according to claim 4, wherein the eccentric members comprise eccentric bearing bushings.

6. The holder device according to claim 1, wherein the locking member comprises two arms coupled between the common rotation axis and one of the holder elements, wherein under spring action the two arms are displaceable in an axial direction of the common rotation axis, and wherein the arms comprise lugs for locking engagement with a second of the holder elements.

7. The holder device according to claim 1, wherein the second of the holder elements comprises two arms mounted about the common rotation axis, the two arms, at an end that is remote from the common rotation axis, support a coupling rail operative to connect equipment.

8. The holder device according to claim 1, wherein one of the holder elements comprises recessed grooves operative to receive a band of material intended to fasten the holder device to the cylindrical body.

* * * * *